US010625533B2

(12) United States Patent
Teufel

(10) Patent No.: US 10,625,533 B2
(45) Date of Patent: Apr. 21, 2020

(54) SECURITY ELEMENT AND DATA CARRIER PROVIDED WITH SAME

(71) Applicant: GIESECKE+DEVRIENT CURRENCY TECHNOLOGY GMBH, München (DE)

(72) Inventor: Björn Teufel, Weissach (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/779,250

(22) PCT Filed: Nov. 29, 2016

(86) PCT No.: PCT/EP2016/002014
§ 371 (c)(1),
(2) Date: May 25, 2018

(87) PCT Pub. No.: WO2017/092864
PCT Pub. Date: Jun. 8, 2017

(65) Prior Publication Data

US 2018/0354292 A1 Dec. 13, 2018

(30) Foreign Application Priority Data

Dec. 1, 2015 (DE) ..... 10 2015 015 731

(51) Int. Cl.
*B42D 25/351* (2014.01)
*B42D 25/23* (2014.01)
(Continued)

(52) U.S. Cl.
CPC ..... *B42D 25/351* (2014.10); *B42D 25/23* (2014.10); *B42D 25/29* (2014.10); *B42D 25/324* (2014.10); *B42D 25/373* (2014.10); *D21H 21/42* (2013.01)

(58) Field of Classification Search
CPC .... B42D 25/351; B42D 25/324; B42D 25/23; B42D 25/29; B42D 25/373; D21H 21/42
(Continued)

(56) References Cited

U.S. PATENT DOCUMENTS 8,403,368 B2 3/2013 Tompkin et al.
2010/0001508 A1 1/2010 Tompkin et al.
(Continued)

FOREIGN PATENT DOCUMENTS

DE 102007005884 A1 8/2008
WO 2005051675 A2 6/2005
WO 2011082761 A1 7/2011

OTHER PUBLICATIONS

International Search Report from PCT Application No. PCT/EP2016/002014, dated Mar. 31, 2017.

*Primary Examiner* — Justin V Lewis
(74) *Attorney, Agent, or Firm* — Workman Nydegger

(57) ABSTRACT

A semi-transparent security element which upon viewing in incident light and in transmitted light has different colors, comprises either (a) a transparent carrier substrate having a front side and a back side. The front side has a metallic layer "V-a" dyed in a first color, obtainable by printing technology by means of dyed metal pigments. The back side has an ink layer appearing in a second color "R-a" and a metallic layer "R-b" dyed in a first color, obtainable by printing technology by means of dyed metal pigments; or (b) a transparent carrier substrate having a front side and a back side. The front side has a semi-transparent metallic layer "V-A" and an ink layer appearing in a first color "V-B" and the back side has an ink layer "R-A" appearing in a second color, a semi-transparent metallic layer "R-B" and an ink layer "R-C" appearing in a first color.

9 Claims, 1 Drawing Sheet

(51) Int. Cl.

| | |
|---|---|
| ***B42D 25/29*** | (2014.01) |
| ***B42D 25/324*** | (2014.01) |
| ***B42D 25/373*** | (2014.01) |
| ***D21H 21/42*** | (2006.01) |

(58) Field of Classification Search
USPC ..... 283/72, 74, 75, 81, 91, 94, 98
See application file for complete search history.

(56) References Cited

U.S. PATENT DOCUMENTS

| | | | | |
|---|---|---|---|---|
| 2010/0308570 | A1* | 12/2010 | Heim ..... | B42D 25/29<br>283/67 |
| 2012/0242075 | A1* | 9/2012 | Lochbihler ..... | D21H 21/42<br>283/85 |

* cited by examiner

SECURITY ELEMENT AND DATA CARRIER PROVIDED WITH SAME

BACKGROUND

The invention relates to a security element, a method for manufacturing the same and a data carrier equipped with the security element, e.g. a value document such as a bank note.

Data carriers, such as value documents or identification documents, or other objects of value, such as branded articles, are often provided for safeguarding purposes with security elements which permit a verification of the authenticity of the data carriers and which at the same time serve as protection from unauthorized reproduction.

In this connection, there are known (transmission-view) security elements having multilayer thin-film elements which upon viewing in incident light, i.e. in reflection, appear in a first color and upon viewing in transmitted light, i.e. in transmission, appear in a second color. WO 2011/082761 A1 describes a thin-film element with multilayer structure which appears gold-colored upon viewing in incident light and blue upon viewing in transmitted light. The multilayer structure is based on two semi-transparent mirror layers and a dielectric spacer layer arranged between the two mirror layers.

On these premises, the invention is based on the object of stating an improved security element of the kind referred to at the outset having high anti-forgery security and attractive visual appearance, as well as a manufacturing method for this purpose. A preferred object is to be seen in that, with regard to the colors, in incident-light viewing and transmissive viewing, a wider color spectrum is available than hitherto.

This object is achieved by the feature combinations defined in the independent claims. Developments of the invention are the subject matter of the subclaims.

SUMMARY OF THE INVENTION

1. (First Aspect of the Invention)

A semi-transparent security element for safeguarding value documents, which upon viewing in incident light and in transmitted light has different colors, comprising a transparent carrier substrate and two metallic layers dyed in a first color, obtainable by printing technology by means of dyed metal pigments, having an ink layer arranged therebetween appearing in a second color. The thickness of the ink layer preferably amounts to 1 to 2 micrometers.

The metal pigments are in particular metal pigments known from WO 2005/051675 A2. Such metal pigments are based on a metal which is chosen preferably from the group consisting of aluminum, stainless steel, nichrome, gold, silver, platinum and copper; the metal is in particular preferably aluminum and the average particle diameter lies preferably in a region from 8 to 15 μm, further preferably in a region from 9 to 10 μm, measured with a Coulter LS130 laser diffraction granulometer; such a printing ink enables e.g. the supplying of a "silver" mirror layer, wherein a golden mirror layer is obtainable in case of the admixing e.g. of a yellow color.

2. (Preferred Embodiment)

The semi-transparent security element according to item 1, comprising a transparent carrier substrate having a front side and a back side, wherein the front side has a metallic layer "V-a" dyed in a first color, obtainable by printing technology by means of dyed metal pigments, and the back side has, in the order, an ink layer "R-a" appearing in a second color and a metallic layer "R-b" dyed in a first color, obtainable by printing technology by means of dyed metal pigments.

3. (Preferred Embodiment)

The semi-transparent security element according to item 2, wherein the transparent carrier substrate on the front side and/or the back side is furnished with an emboss-lacquer layer which has in particular a relief structure forming a diffractive structure and/or a relief structure forming a micromirror arrangement.

4. (Preferred Embodiment)

The semi-transparent security element according to item 2 or 3, wherein a metallic layer "V-a" dyed in a first color, obtainable by printing technology by means of dyed metal pigments, as well as the metallic layer "R-b" dyed in a first color, obtainable by printing technology by means of dyed metal pigments obtainable, respectively are metallic layers dyed in yellow and the ink layer "R-a" appearing in a second color is a blue ink layer.

5. (Second Aspect of the Invention)

The semi-transparent security element for safeguarding value documents, which upon viewing in incident light and in transmitted light has different colors, comprising a transparent carrier substrate having two semi-transparent metallic layers having an ink layer arranged therebetween appearing in a first color. The thickness of the ink layer preferably amounts to 1 to 2 micrometers.

6. (Preferred Embodiment)

The semi-transparent security element according to item 5, comprising a transparent carrier substrate having a front side and a back side, wherein the front side has, in the order, a semi-transparent metallic layer "V-A" and an ink layer "V-B" appearing in a first color and the back side has, in the order, an ink layer "R-A" appearing in a second color, a semi-transparent metallic layer "R-B" and an ink layer "R-C" appearing in a first color. The thickness of the ink layers preferably amounts respectively to 1 to 2 micrometers.

7. (Preferred Embodiment)

The semi-transparent security element according to item 6, wherein the transparent carrier substrate on the front side and/or the back side is furnished with an emboss-lacquer layer which has in particular a relief structure forming a diffractive structure and/or a relief structure forming a micromirror arrangement.

8. (Preferred Embodiment)

The semi-transparent security element according to item 6 or 7, wherein the semi-transparent metallic layer "V-A" and the semi-transparent metallic layer "R-B" are formed independently of each other of a metal and the metal respectively is chosen from the group consisting of Al, Ag, Ni, Cr, Cu, Au and an alloy of one or several the hereinabove mentioned elements.

9. (Preferred Embodiment)

The semi-transparent security element according to any of items 6 to 8, wherein an ink layer "V-B" appearing in a first color and the ink layer "R-C" appearing in a first color respectively is a yellow ink layer and the ink layer "R-A" appearing in a second color is a blue ink layer.

10. (Preferred Embodiment)

The security element according to any of items 1 to 9, wherein the security element is an (endless) strip, an (endless) thread or a patch or label.

11. (Third Aspect of the Invention)

A data carrier having a security element according to any of items 1 to 10.

12. (Preferred Embodiment)

The data carrier according to item 11, wherein the data carrier is a value document, such as a bank note, in particular a paper bank note, polymer bank note or foil composite bank note, or identification card.

13. (Preferred Embodiment)

The data carrier according to item 11 or 12, wherein the security element is arranged above a window region formed in the data-carrier substrate.

DETAILED DESCRIPTION OF THE INVENTION

The value document stated in the present description can be a bank note, in particular a paper bank note, a polymer bank note or a foil composite bank note, a share, a bond, a deed, a voucher, a check, a high-value admission ticket, but also an identification card, such as a credit card, a bank card, a cash payment card, an authorization card, an identity card or a passport personalization page.

A viewing in incident light as intended by this invention is an illumination of the security element from one side and a viewing of the object from the same side. A viewing in incident light is thus present, for example, when the front of the security element is illuminated and also viewed.

A viewing in transmitted light as intended by this invention is an illumination of a security element from one side and a viewing of the security element from another side, in particular the opposite side. A viewing in transmitted light is therefore present, for example, when the back side of the security element is illuminated and the front side of the security element is viewed. The light thus shines through the security element.

The security element according to the invention can be present e.g. as a patch or label, as (an endless) strip or as (an endless) thread.

The transparent carrier substrate of the security element can be in particular a plastic foil, e.g. a polyethylene terephthalate (PET) foil or the like.

The data-carrier substrate to be equipped with the security element according to the invention of the data carrier is in particular a paper substrate or a paper-like substrate, a polymer substrate, a paper/foil/paper-composite substrate or a foil/paper/foil-composite substrate. A value document furnished with a window region or safety paper can be generated in case of a paper substrate, a paper/foil/paper-composite substrate or a foil/paper/foil-composite substrate, e.g. by means of a continuous recess within the paper layer(s). Alternatively, the paper layer can in a certain region be made transparent by means of a suitable liquid, e.g. by means of aqueous sulfuric acid solution. In case of a value document based on a transparent polymer substrate, a window region can be generated, e.g. by means of congruent recesses in the opaque printed layers applied to the front side and back side of the polymer substrate.

The semi-transparent security element according to the invention which has different colors upon viewing in incident light and in transmitted light can have the following layer buildup according to a first variant:

a) metallic layer dyed in a first color (layer "V-a", wherein the letter "V" designates the front side of the carrier substrate), obtainable by printing technology by means of dyed metal pigments;
b) transparent carrier substrate;
c) an ink layer appearing in a second color (layer "R-a", wherein the letter "R" designates the back side of the carrier substrate);
d) a metallic layer (layer "R-b") dyed in a first color, obtainable by printing technology by means of dyed metal pigments.

The above-mentioned colors, i.e. the first color and the second color, can be in particular complementary colors (e.g. the first color is yellow and the second color blue).

The metal pigments insertable into the layers a) and d) of the above layer buildup are in particular metal pigments known from WO 2005/051675 A2. Such metal pigments are based on a metal which is chosen preferably from the group consisting of aluminum, stainless steel, nichrome, gold, silver, platinum and copper; the metal is in particular preferably aluminum and the average particle diameter lies preferably in a region from 8 to 15 μm, further preferably in a region from 9 to 10 μm, measured with a Coulter LS130 laser diffraction granulometer; such a printing ink enables e.g. the supplying of a "silver" mirror layer.

The transparent carrier substrate on the front side and/or the back side, e.g. between the layers a) and b) and/or between the layers b) and c), can be furnished with an emboss-lacquer layer which has in particular a relief structure forming a diffractive structure and/or a relief structure forming a micromirror arrangement.

The semi-transparent security element according to the invention which has different colors upon viewing in incident light and in transmitted light can have the following layer buildup according to a second variant:

A) an ink layer appearing in a first color (layer "V-B");
B) a semi-transparent metallic layer (layer "V-A");
C) transparent carrier substrate;
D) an ink layer appearing in a second color (layer "R-A");
E) a semi-transparent metallic layer (layer "R-B"); and
F) an ink layer appearing in a first color (layer "R-C").

The above-mentioned colors, i.e. the first color and the second color, can be in particular complementary colors (e.g. the first color is yellow and the second color blue).

It is preferred that both semi-transparent metallic layers B) and E) are formed independently of each other of a metal and the metal respectively can be chosen from the group consisting of Al, Ag, Ni, Cr, Cu, Au and an alloy of one or several the hereinabove mentioned elements. The layer thickness of the semi-transparent metallic layer lies preferably in a region of 5 nm to 15 nm. It is in particular preferably that each of the layers B) and E) is respectively an Al layer.

The transparent carrier substrate on the front side and/or the back side, e.g. between the layers B) and C) and/or between the layers C) and D), can be furnished with an emboss-lacquer layer which has in particular a relief structure forming a diffractive structure and/or a relief structure forming a micromirror arrangement.

The semi-transparent security element according to the invention which has different colors upon viewing in incident light and in transmitted light can have the following layer buildup according to a third variant:

A) a semi-transparent metallic layer (layer "V-A");
B) transparent carrier substrate;
C) an ink layer appearing in a first color (layer "R-A"); and
D) a semi-transparent metallic layer (layer "R-B").

It is preferred that both semi-transparent metallic layers A) and D) are formed independently of each other of a metal and the metal respectively can be chosen from the group consisting of Al, Ag, Ni, Cr, Cu, Au and an alloy of one or several the hereinabove mentioned elements. The layer thickness of the semi-transparent metallic layer lies preferably in a region of 5 nm to 15 nm. It is in particular preferably that each of the layers A) and D) is respectively a Cu layer.

The transparent carrier substrate on the front side and/or the back side, e.g. between the layers A) and B) and/or between the layers B) and C), can be furnished with an emboss-lacquer layer which has in particular a relief structure forming a diffractive structure and/or a relief structure forming a micromirror arrangement.

The semi-transparent security element according to the invention which has different colors upon viewing in incident light and in transmitted light can have the following layer buildup according to a fourth variant:

A) a semi-transparent metallic layer (layer "V-A");
B) transparent carrier substrate;
C) a dielectric layer obtainable by printing technology, which is based in particular on nitrocellulose (layer "R-A"); and
D) a semi-transparent metallic layer (layer "R-B").

It is preferred that both semi-transparent metallic layers A) and D) are formed independently of each other of a metal and the metal respectively can be chosen from the group consisting of Al, Ag, Ni, Cr, Cu, Au and an alloy of one or several the hereinabove mentioned elements. The layer thickness of the semi-transparent metallic layer lies preferably in a region of 5 nm to 15 nm. It is in particular preferably that each of the layers A) and D) is respectively an Al layer.

The transparent carrier substrate on the front side and/or the back side, e.g. between the layers A) and B) and/or between the layers B) and C), can be furnished with an emboss-lacquer layer which has in particular a relief structure forming a diffractive structure and/or a relief structure forming a micromirror arrangement.

BRIEF DESCRIPTION OF THE DRAWINGS

Further embodiment examples as well as advantages of the invention will be explained hereinafter with reference to the figures, in whose representation a rendition that is true to scale and to proportion has been dispensed with in order to increase the clearness.

There are shown:

DETAILED DESCRIPTION OF VARIOUS EMBODIMENTS

Figure 1:
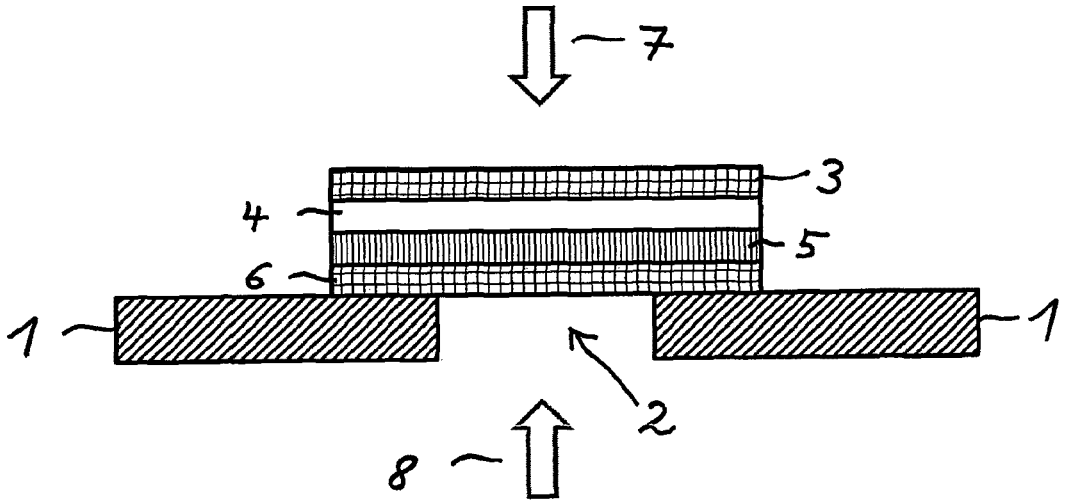
Figure 2:
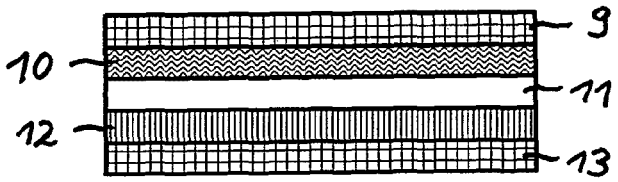
Figure 3:
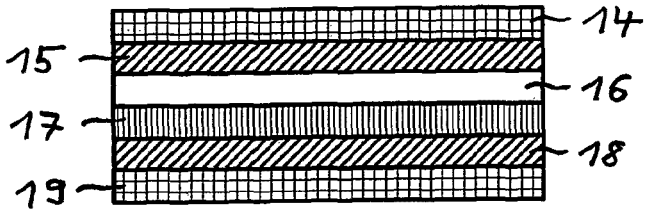

FIG. 1 a security element according to the invention;

FIG. 2 a further security element according to the invention;

FIG. 3 still a further security element according to the invention.

EXEMPLARY EMBODIMENT 1

FIG. 1 shows a value document, namely a bank note, having a window region and a security element according to the invention applied to the value-document substrate in the window region. The window region of the value document is formed by a recess generated e.g. by means of punching 2 in the paper layer 1. The security element has the following layers:

a) a metallic layer 3 dyed in yellow color, obtainable by printing technology by means of yellow-dyed metal pigments;
b) a transparent carrier substrate 4;
c) a blue color lacquer 5;
d) a metallic layer 6 dyed in yellow color, obtainable by printing technology by means of yellow-dyed metal pigments.

The security element can have on the surface of the layer 6 (not shown in FIG. 1) an adhesive layer, e.g. a heat seal coating, for bonding the security element to the paper layer 1 of the value document.

The block arrow 7 shows the view of the front side of the security element. Upon viewing the front side of the security element in incident light, the viewer perceives the security element in golden color.

The block arrow 8 shows the view of the back side of the security element. Upon viewing the back side of the security element in incident light, the viewer perceives the security element in golden color.

Upon viewing in transmitted light, from the front side as well as from the back side, the security element appears in the color blue.

EXEMPLARY EMBODIMENT 2

FIG. 2 shows a security element according to the invention according to a further embodiment example. The security element has the following layers:

a) a metallic layer 9 dyed in yellow color, obtainable by printing technology by means of yellow-dyed metal pigments;
b) an emboss-lacquer layer 10, e.g. a UV lacquer, which contains in particular a relief structure forming a diffractive structure and/or a relief structure forming a micromirror arrangement;
c) a transparent carrier substrate 11;
d) a blue color lacquer 12;
e) a metallic layer 13 dyed in yellow color, obtainable by printing technology by means of yellow-dyed metal pigments.

Upon viewing in transmitted light, from the front side as well as from the back side, the security element appears in the color blue.

Upon viewing of the front side in incident light, as well as upon viewing the back side in incident light, the viewer perceives the security element in golden color. The viewer thereby perceives in incident light a hologram and/or a micromirror arrangement upon viewing of the metallic layer 9.

EXEMPLARY EMBODIMENT 3

FIG. 3 shows a security element according to the invention according to a further embodiment example. The security element has the following layers:

A) a yellow color lacquer 14;
B) a semi-transparent Al layer 15;
C) a transparent carrier substrate 16;
D) a blue color lacquer 17;
E) a semi-transparent Al layer 18; and
F) a yellow color lacquer 19.

Upon viewing in transmitted light, from the front side as well as from the back side, the security element appears in the color blue.

Upon viewing of the front side in incident light, as well as upon viewing the back side in incident light, the viewer perceives the security element in golden color.

EXEMPLARY EMBODIMENT 4

A further security element according to the invention has the following layers:

A) a yellow color lacquer;
B) a semi-transparent Al layer;
C) a transparent carrier substrate;
D) a red color lacquer;
E) a semi-transparent Al layer; and
F) a yellow color lacquer.

Upon viewing in transmitted light, from the front side as well as from the back side, the security element appears in reddish color.

Upon viewing of the front side in incident light, as well as upon viewing the back side in incident light, the viewer perceives the security element in golden color.

EXEMPLARY EMBODIMENT 5

A further security element according to the invention has the following layers:

a transparent carrier substrate;
a Cu layer;
a color lacquer in the color green;
a Cu layer;

Upon viewing in transmitted light, from the front side as well as from the back side, the security element appears in the color green.

Upon viewing of the front side in incident light, as well as upon viewing the back side in incident light, the viewer perceives the security element in metallic-copper color.

EXEMPLARY EMBODIMENT 6

A further security element according to the invention has the following layers:

a metallic layer dyed in yellow color, obtainable by printing technology by means of yellow-dyed metal pigments;
a transparent carrier substrate;
a green color lacquer;
a metallic layer dyed in yellow color, obtainable by printing technology by means of yellow-dyed metal pigments.

Upon viewing in transmitted light, from the front side as well as from the back side, the security element appears in the color green.

Upon viewing of the front side in incident light, as well as upon viewing the back side in incident light, the viewer perceives the security element in golden color.

EXEMPLARY EMBODIMENT 7

A further security element according to the invention has the following layers:

a metallic layer dyed in yellow color, obtainable by printing technology by means of yellow-dyed metal pigments;
a transparent carrier substrate;
a red color lacquer;
a metallic layer dyed in yellow color, obtainable by printing technology by means of yellow-dyed metal pigments.

Upon viewing in transmitted light, from the front side as well as from the back side, the security element appears in the color red.

Upon viewing of the front side in incident light, as well as upon viewing the back side in incident light, the viewer perceives the security element in golden color.

EXEMPLARY EMBODIMENT 8

A further security element according to the invention has the following layers:

a transparent carrier substrate;
an emboss-lacquer layer, e.g. a UV lacquer, which contains in particular a relief structure forming a diffractive structure and/or a relief structure forming a micromirror arrangement;
a metallic layer dyed in yellow color, obtainable by printing technology by means of yellow-dyed metal pigments;
a blue color lacquer;
a metallic layer dyed in yellow color, obtainable by printing technology by means of yellow-dyed metal pigments.

Upon viewing in transmitted light, from the front side as well as from the back side, the security element appears in the color blue.

Upon viewing of the front side in incident light, as well as upon viewing the back side in incident light, the viewer perceives the security element in golden color. The viewer thereby perceives in incident light a hologram and/or a micromirror arrangement upon viewing of the metallic layer.

EXEMPLARY EMBODIMENT 9

A further security element according to the invention has the following layers:

a metallic layer dyed in yellow color, obtainable by printing technology by means of yellow-dyed metal pigments;
a transparent carrier substrate;
a green color lacquer which is imprinted in the form of a line-shaped pattern;
a metallic layer dyed in yellow color, obtainable by printing technology by means of yellow-dyed metal pigments.

Upon viewing in transmitted light, from the front side as well as from the back side, the security element appears in the form of a green, line-shaped motif.

Upon viewing of the front side in incident light, as well as upon viewing the back side in incident light, the viewer perceives the security element in golden color.

The invention claimed is:

1. A semi-transparent security element for safeguarding value documents, which semi-transparent security element upon viewing in incident light and in transmitted light has different colors, comprising a transparent carrier substrate having a front side and a back side and first and second metallic layers "V-a", "R-b", respectively, dyed in a first color, having an ink layer "R-a" arranged between the first and second metallic layers "V-a," "R-b" and appearing in a second color;

wherein the front side of the transparent carrier substrate has the first metallic layer "V-a" dyed in the first color, and the back side of the transparent carrier substrate has the ink layer "R-a" appearing in the second color and adjacent the back side of the transparent carrier substrate and the second metallic layer "R-b" dyed in the first color and adjacent the ink layer "R-a";

wherein the transparent carrier substrate on the front side and/or the back side is furnished with an emboss-lacquer layer which has a relief structure forming a diffractive structure and/or a relief structure forming a micromirror arrangement.

2. The semi-transparent security element according to claim 1, wherein the first metallic layer "V-a" dyed in the first color, as well as the second metallic layer "R-b" dyed in the first color, respectively are metallic layers dyed in yellow and the ink layer "R-a" appearing in the second color is a blue ink layer.

3. The security element according to claim 1, wherein the security element is a strip, a thread or a patch or label.

4. A data carrier having a security element according to claim 1.

5. The data carrier according to claim 4, wherein the data carrier is a paper bank note, polymer bank note or foil composite bank note, or identification card.

6. The data carrier according to claim 4, wherein the security element is arranged above a window region formed in the data-carrier substrate.

7. A semi-transparent security element for safeguarding value documents, which semi-transparent security element upon viewing in incident light and in transmitted light has different colors, comprising a transparent carrier substrate having a front side and a back side;

wherein the front side of the transparent carrier substrate has an ink layer "V-B" appearing in a first color and a semi-transparent metallic layer "V-A" adjacent the ink layer "V-B" and the front side of the transparent carrier substrate, and the back side of the transparent carrier substrate has an ink layer "R-A" appearing in a second color and adjacent the back side of the transparent carrier substrate, a semi-transparent metallic layer "R-B" adjacent the ink layer "R-A", and an ink layer "R-C" appearing in the first color and adjacent the semi-transparent metallic layer "R-B";

wherein the transparent carrier substrate on the front side and/or the back side is furnished with an emboss-lacquer layer which has a relief structure forming a diffractive structure and/or a relief structure forming a micromirror arrangement.

8. The semi-transparent security element according to claim 7, wherein the semi-transparent metallic layer "V-A" and the semi-transparent metallic layer "R-B" are formed independently of each other of a metal and the metal respectively is chosen from the group consisting of Al, Ag, Ni, Cr, Cu, Au and an alloy of one or several the hereinabove mentioned elements.

9. The semi-transparent security element according to claim 7, wherein the ink layer "V-B" appearing in a first color and the ink layer "R-C" appearing in the first color respectively is a yellow ink layer and the ink layer "R-A" appearing in the second color is a blue ink layer.

* * * * *